United States Patent [19]

Doherty

[11] Patent Number: 4,742,918

[45] Date of Patent: May 10, 1988

[54] APPARATUS FOR COMPILING SORTED LUMBER

[75] Inventor: Ralph D. Doherty, Jacksonville, Fla.

[73] Assignee: U.S. Natural Resources, Inc., Portland, Oreg.

[21] Appl. No.: 913,028

[22] Filed: Sep. 29, 1986

[51] Int. Cl.[4] ..... B07C 5/14

[52] U.S. Cl. ..... 209/517; 209/933; 414/268

[58] Field of Search ..... 209/517, 518, 520, 521, 209/933; 414/268, 49

[56] References Cited

U.S. PATENT DOCUMENTS

| | | | |
|---|---|---|---|
| 3,653,506 | 4/1972 | Turner et al. | 209/933 |
| 3,696,948 | 10/1972 | Murdock et al. | 209/517 |
| 3,700,120 | 10/1972 | Romick et al. | 209/933 |
| 4,098,407 | 7/1978 | Moore | 209/517 |
| 4,104,156 | 8/1978 | Fletcher | 209/521 |
| 4,348,145 | 9/1982 | Marklund et al. | 414/268 |
| 4,610,360 | 9/1986 | Forslund | 209/933 |

FOREIGN PATENT DOCUMENTS

| | | | |
|---|---|---|---|
| 2722793 | 9/1978 | Fed. Rep. of Germany | 209/933 |
| 2521038 | 8/1983 | France | 209/517 |
| 410149 | 5/1977 | Sweden | 414/268 |

*Primary Examiner*—Robert B. Reeves
*Assistant Examiner*—Donald T. Hajec
*Attorney, Agent, or Firm*—Robert L. Harrington

[57] ABSTRACT

A lumber sorting apparatus wherein a bin collects graded lumber. Flexible straps across the bottom are extended to expand the lumber holding capacity. One end of the strap has a releasable latch mechanism and latching of the strap (after dumping the lumber) is provided by a rigid pivotal arm that receives the latch mechanism in the rewinding operation and pivots the latch mechanism into place for relatching. The arm member includes a length portion that spans the open bottom. Guide pins in the arm member on either side of the length portion define a straight reach across said length portion which is offset downwardly from the straps whereby lumber pieces dropped into the bin are prevented from impacting the rigid arm member.

3 Claims, 1 Drawing Sheet

APPARATUS FOR COMPILING SORTED LUMBER

This application has similar disclosures to that of a simultaneously filed application, U.S. Ser. No. 912,955, having the same inventor and same assignee, the claims of which are directed to a different feature of the disclosure.

FIELD OF INVENTION

This invention relates to an apparatus that sorts and accumulates graded lumber, and more particularly to design features which will alleviate lumber damage during the sorting process.

HISTORY OF INVENTION

Lumber when cut from logs in a log mill are of a mixed variety of grade types which are desirably sorted. Obviously each grade type has a different value and is thus sold separately from other grade types. Sorting of the lumber pieces is typically accomplished by conveying the lumber along overhead conveyers. Diverter mechanism operated by an operator diverts selected lumber pieces from the conveyor and into a collection bin. A trap door-like lever is opened and the selected lumber simply falls from the conveyor into the underlying collection bin.

Whereas lumber can be easily damaged if materially impacted i.e. if dropped from a significant height into the bin, the bins are expandable, first from a shallow container having a short drop from the conveyor and expanding as needed to generally maintain that short drop as lumber pieces are added.

Expandability is provided by straps that form a sling for the lumber. The straps are elongated as needed (one end being wound on a reel) to thus enlarge the sling and thereby accommodate a substantial number of the lumber pieces. The sling or bin is unloaded by simply unreeling the one end of the straps until the lumber is resting on an underlying floor. The other ends of the straps are attached by a releasable fastener. With the lumber resting on the floor, the attached end is released and dropped to the floor. The straps are then retracted to draw the straps from under the lumber and back to the start up position.

The released strap end has to be reattached. A mechanism for reattachment of the strap end is disclosed in U.S. Pat. No. 4,098,407 issued to Jack Moore on July 4, 1978. (See also U.S. Pat. No. 4,104,156 issued to John K. Fletcher, Aug. 1, 1978.) This mechanism utilizes a rigid arm member. The arm is pivoted at one end to the apparatus at a location adjacent the spool. The straps from the spool are threaded through guides at the opposite or outer end of the arm. The guides permit sliding of the strap therethrough but not the fastener that is fixed to the end of the strap. Thus the strap is wound back onto the spool until the fastener engages the arm end. Continued reeling in of the strap then causes pivoting of the arm to raise the unattached end of the strap back to its home position. The end is relatched and the bin is ready to receive a new batch of sorted lumber.

The problem that is encountered in the above relatching mechanism (and to which the present invention is directed) is that the rigid arm forms the bottom of the bin during the start up of the sorting operation. Even a short drop of 18 inches or so onto a rigid arm will cause considerable damage to the lumber and is undesirable.

SUMMARY OF THE INVENTION

The preferred embodiment of the present invention is directed to an improvement of the above described relatching mechanism. It provides a rigid pivotal arm for relatching but in a design whereby the arm is not directly contacted by the lumber pieces when they are dropped into the bin.

In summary, the arm is formed and fitted with strap guides whereby with the arm in a full upwardly pivoted position, the arm portion spanning the bottom of the bin is below the taut straps. Thus lumber pieces initially dropped into the bin impact the straps and not the rigid arm.

The specifics of the invention will be more clearly understood and appreciated by reference to the following detailed description and drawings wherein.

Figure 1:
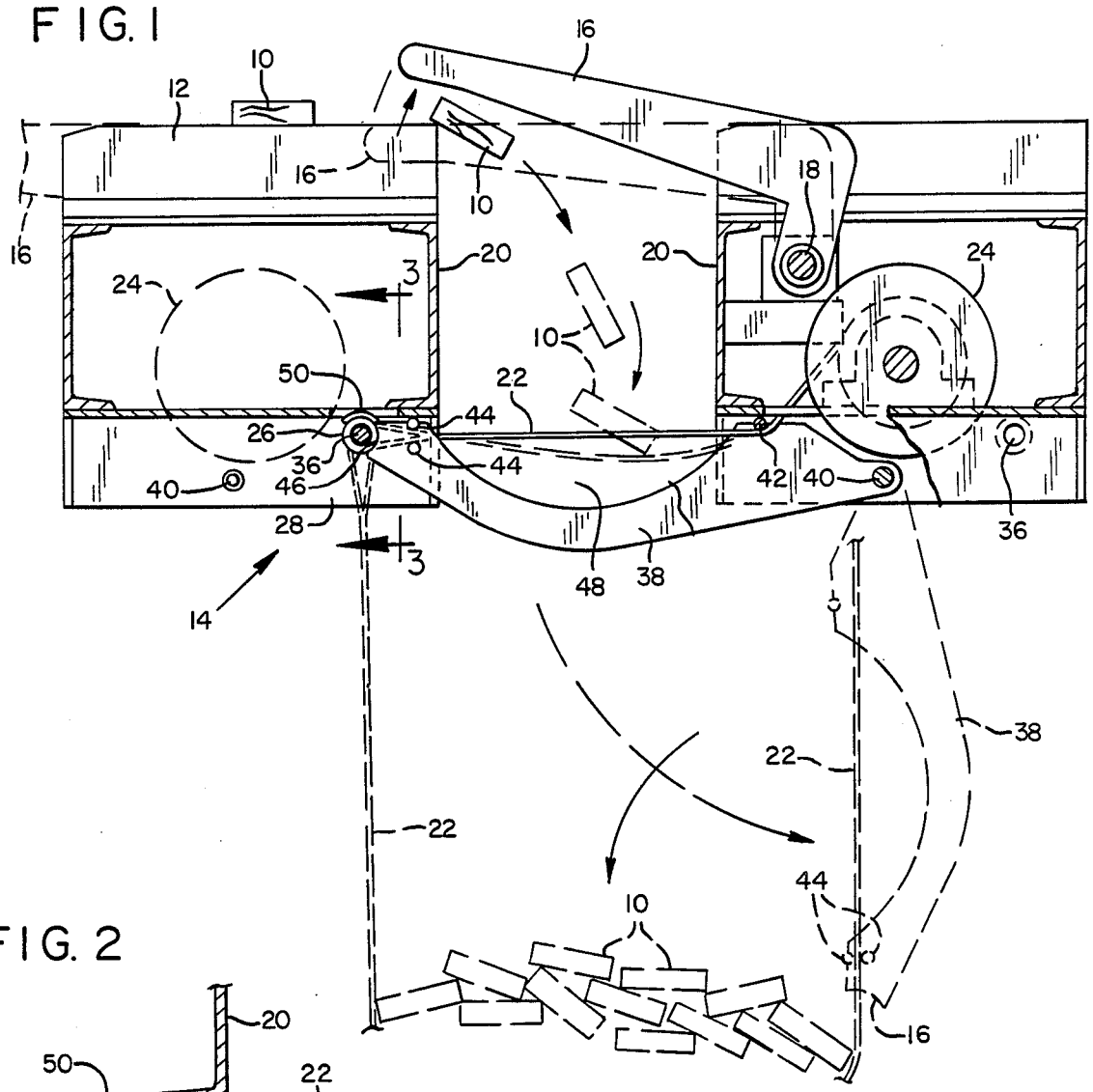
FIG. 1 illustrates a sorting mechanism utilizing the present invention.
Figure 2:
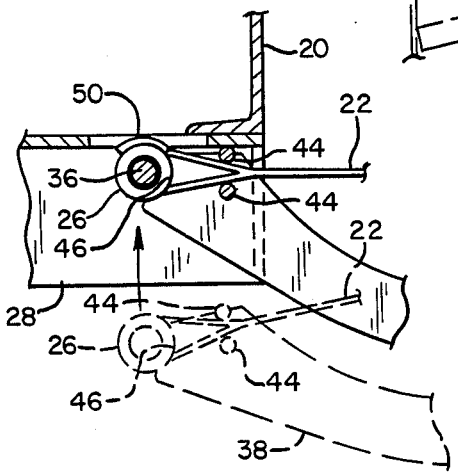
FIG. 2 is a view, partially in section, illusrating the arm member being utilized for relatching the strap end.

Referring to FIG. 1 of the drawings, it will be appreciated that lumber pieces 10 are drawn along slide rails 12 (e.g. by a drag chain not shown). Sorting bins 14 are provided at spaced positions below the rails as illustrated i.e. the sorting bin illustrated is only one of a number of bins located along the path of the lumber pieces. Gaps are provided in the slide rails in the areas directly over the bins. Continued sliding movement across the openings caused by these slide rail gaps is enabled by sorting levers 16. The sorting levers 16 are pivoted as at pivot 18, and operating mechanism (not shown) is activated to raise and lower the levers about the pivot 18. In FIG. 1, lever 16 is shown in a raised position in solid line and in a lowered position in dash lines. It will thus be appreciated that the operator determines which of the lumber pieces are of a particular grade type, and as the lumber pieces approach the appropriate sorting bin, lever 16 is raised and the selected lumber pieces are diverted into that bin.

The bin 14 is provided with various support braces and brackets for supporting the various apparatus components including side walls 20. The bottom is open except for straps 22 there across. It will be appreciated that in order to support the lumber pieces, at least two such straps are required. For example, if the lumber being sorted is 2 by 4s that are eight feet in length, the bin is eight feet plus in width and the straps may be located inwardly from each end between one and two feet. The straps are thus spaced apart between four and six feet. A convenient cross section dimension of the bin is one foot in length and a depth initially (i.e. the drop from the conveyer to the taut straps), of about 1.5 feet. Whereas only one strap and its support mechanism are shown, the reader will understand that a second strap and its support mechanism are contemplated and that the two mechanism function in concert.

The strap 22 has a substantial length with a major portion wound on a reel 24 that is mounted behind one wall 20 of the bin. The operating mechanism for the reel is not unique and it will suffice to explain that is powered by a motor that can be manually or automatically operated to reel-out or reel-in the strap 22 as required for the sorting operation. The outer end of the strap is provided with a spool-like end member 26 (the strap end is looped around the end member).

As seen in FIG. 1, mounted below and behind the opposite side wall 20 are brackets 28 that fixedly carry a pair of spaced sleeve-like guide members 30. A further bracket 32 supports an air cylinder 34 which controls movement of a lock pin 36. The lock pin 36 is aligned with the spaced guide members 30 and is of a size and has a length of travel for insertion through the pair of guide members.

Figure 3:
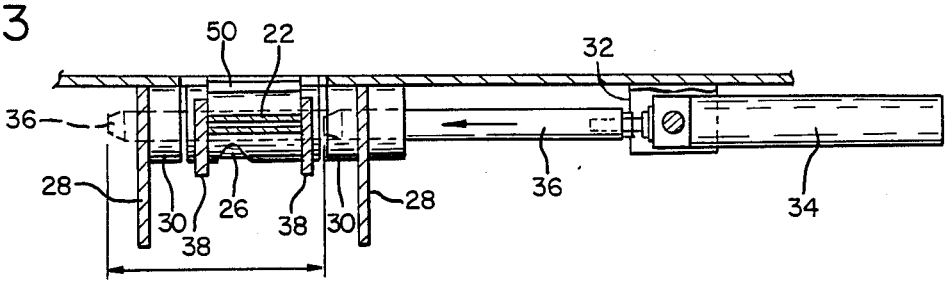
FIG. 3 is a view of the latching mechanism for the strap as taken on view lines 3—3 of FIG. 1.

The guide members are adapted to receive there between the spool like end member 26 fixed to the end of the strap. As seen in FIG. 3, with the end member 26 located between the guide members 30, and with the pin 36 extended through the spool (which has a center opening) and the guide members, the end member 26 and thus the strap end is held fast to the overhead apparatus at a position behind the sidewall 20.

Before explaining the arm member 38, the general function of the strap 22, the fastening mechanism therefore, and the reel 24 will be explained. As lumber pieces 10 are dropped into the bin and start to fill it, the reel 24 is activated to reel-out the strap 22. The reeling out function is controlled to ensure that the lumber pieces never drop greater than about the initial 1.5 feet. When the strap accumulates a desired quantity of the lumber pieces, the operator reels out the strap until the lumber pieces settle onto the floor below the bin. The air cylinder 34 is then activated to withdraw the pin 36 so that the end of the strap (secured to spool 26) is free to fall to the floor. The reel 24 then is reversed to reel in the strap end which is pulled out from under the lumber pile and then upwardly toward the reel 24. The strap end is then swung over to the guide members 30 to be refastened by the pin 36 which is the function of the arm 38 which will now be explained.

The arm 30 is pivoted at pivot point 40, just below the reel 24. Except for its connection to the strap 22, the arm is otherwise free to pivot about pivot point 40. At the free end of the arm is a pair of guide pins 44. These pins are spaced apart sufficiently to permit free sliding of the strap there between. The strap 22 is inserted through the arm and between the guide pins as shown. At the outer end of the arm is a limiting seat 46 that includes a passageway for the strap but prevents passage there-past of the spool-like member 26. The strap extends along the arm rearwardly (or upwardly as seen in dash lines in FIG. 1) and then under a bearing pin 42 located near the pivotal end of the arm. From the bearing pin the strap extends upwardly to the reel 24 (and note that the strap extends inwardly of the pivot 40).

In operation, as the strap is reeled in, it is being reeled through the limiting seat 46. When the spool-like member 26 engages the limiting seat of the arm 38, continued reeling in of the strap forces upward pivoting of the arm. (Note the alignment of strap 22 in the dash position of FIG. 1. A pulling force on the strap produces a moment arm of force around pivot 40 to thereby force pivoting of the arm.) As the arm is rigid and journaled at 40 so as to only move in a fixed pivotal arc, the continued reeling and pivoting of arm 38 pivots the end member 26 to its "home" position between guides 30. When in this home position, the air cylinder is activated to drive the lock pin 36 back through the guide members and spool member to reattach the strap end.

Of significance to the arm design is the spacing 48 that is created under the strap 22 when the strap is pulled taut across the bin bottom. This spacing is created by configuring the arm to support the guide pins 44 and bearing pin 42 outwardly of walls 20. The intermediate arm portion spanning the bin bottom, is offset downwardly from a straight line between the upper guide pin 44 and bearing pin 42. Thus the lumber pieces initially dropped into the bin (as illustrated) will be cushioned by the taut strap 22.

Also of importance is the simple mechanism for locking and unlocking the end fastener of the strap to the guide members 30. With the arm journaled as described, the pivotal movement of the arm upwardly automatically locates the end fastener (a stop member 48 is desirable so that the arm can simply be pivoted until it stops), at which location the spool end member is aligned with the openings in the guide members and the lock pin 36. The sliding operation of the air actuated pin 36 is simple and reliable with a minimum of moving parts. Maintenance is thereby reduced and replacement of these locking parts is inexpensive.

These and other advantages will be realized by an appreciation of the illustrated embodiment. It is subject to numerous modifications without departing from the inventive concept which is defined by the claims appended hereto.

What is claimed is:

1. A lumber sorting apparatus comprising;

a bin having a pair of lumber confining side walls defining an interior area and an open bottom, at least a pair of strong flexible straps spanning the open bottom from one side wall to the opposite side wall and having a length substantially longer than said open bottom between the side walls, a reel for each strap that is fixed to one end of the strap and mounted proximate to one side wall on the outside thereof, said reel including means for power winding the strap length onto and off of the reel, an arm member for each strap having first and second ends, the first end pivotally connected proximate the reel and outside the interior area and said arm member being pivotal about said first end between an upper position and a lower position, guide means on said arm member defining a path for the strap from the reel to the second end of the arm member whereby reeling in of the strap causes drawing of the strap through the arm member, a fitting fixed proximate the opposite side wall and outside the interior area, a mating member mated to the fitting and fixed a second end of the strap, and releasable fastening means releasably fastening the mating member to the fitting, said arm member having an intermediate length portion between said first and second ends, said intermediate portion spanning the width of the open bottom when the arm member is pivoted to its upper position, said arm member at its second end having a seat in which the mating member at the strap end becomes seated for stopping further drawing of the strap through the arm member when the strap is wound on the reel, said arm member thereby being pivoted to its upper position by continued power winding of the reel, the seated position of the mating member on the arm member coordinated with the position of the fitting so as to pivot the mating member of said strap end into mating relationship with the fitting, and said arm member being configured whereby the path of the strap between the ends of the arm member with the strap pulled taut defines a straight reach of the strap above the said intermediate portion of the arm member spanning the open bottom of the bin, and with the arm member so positioned, exposing only the straps to be engaged by lumber pieces dropped into the bin.

2. A lumber sorting apparatus as defined in claim 1 comprising guide pins on the arm member forward and rearward of the said length portion which establishes the straight reach of the strap when pulled taut by the reel, and said intermediate length portion of the arm member being downwardly offset from the guide pins.

3. A lumber sorting apparatus as defined in claim 2 wherein said intermediate length portion is concavely curved.

* * * * *